US007927294B2

(12) United States Patent
Kamimura et al.

(10) Patent No.: US 7,927,294 B2
(45) **Date of Patent: *Apr. 19, 2011**

(54) MASSAGING DEVICE

(75) Inventors: Tetsuya Kamimura, Tsubame (JP); Fujie Hayakawa, Tsubame (JP); Kazuyuki Takeda, Tsubame (JP)

(73) Assignee: Twinbird Corporation, Niigata (JP)

( * ) Notice: Subject to any disclaimer, the term of this patent is extended or adjusted under 35 U.S.C. 154(b) by 1126 days.

This patent is subject to a terminal disclaimer.

(21) Appl. No.: 11/655,408

(22) Filed: Jan. 19, 2007

(65) Prior Publication Data

US 2007/0203436 A1 Aug. 30, 2007

(30) Foreign Application Priority Data

Feb. 28, 2006 (JP) ..... 2006-053738

(51) Int. Cl.
*A61H 7/00* (2006.01)

(52) U.S. Cl. ..... 601/97; 601/93; 601/95; 601/103

(58) Field of Classification Search ..... 601/93, 601/95, 97, 101, 103, 113, 134, 136, 137, 601/139, 142

See application file for complete search history.

(56) References Cited

U.S. PATENT DOCUMENTS

| | | | | |
|---|---|---|---|---|
| 1,554,510 | A * | 9/1925 | Kirby | 15/188 |
| 1,726,560 | A * | 9/1929 | Hassler | 601/136 |
| 1,974,031 | A * | 9/1934 | Merrill | 601/154 |
| 2,369,881 | A | 2/1945 | Berns et al. | |
| 5,311,860 | A * | 5/1994 | Doria | 601/103 |
| 2003/0149382 | A1 * | 8/2003 | Waller | 601/137 |
| 2008/0234611 | A1 * | 9/2008 | Sakai et al. | 601/95 |
| 2009/0182249 | A1 * | 7/2009 | Sakai et al. | 601/136 |

FOREIGN PATENT DOCUMENTS

| | | |
|---|---|---|
| DE | 243 0 257 A1 | 1/1976 |
| DE | 93 09 142.7 | 8/1993 |
| JP | 58-179130 | 11/1983 |
| JP | 60-135123 | 7/1985 |
| JP | 60-135123 | 9/1985 |
| JP | 61-192730 | 1/1986 |
| JP | 6-29532 | 4/1994 |
| JP | H07-039566 | 2/1995 |
| JP | 2008-141030 | 6/1996 |
| JP | 8-507246 | 8/1996 |
| JP | 2009-122192 | 5/1997 |
| JP | H10-015006 | 1/1998 |

(Continued)

*Primary Examiner* — Quang D Thanh
(74) *Attorney, Agent, or Firm* — Boyle Fredrickson, S.C.

(57) ABSTRACT

Disclosed are devices capable of performing a massage and wash on a scalp or massage on an affected area gently and effectively by a brush section or a treating section thereof. A plurality of projections are integrally formed on a surface of a flexible body plate of brush section, so that the projections are symmetrical with respect to an axis line A and an axis line D of the projection is perpendicular with the surface of the body plate. An edge of the body plate is fixed on a frame. A motor serving as a drive section is activated allowing a reciprocating drive means to repeatedly deform the body plate coupled thereto between an upwardly-deflected curved concave position and a downwardly-deflected curved convex position along the axis line A, thereby allowing each distance among a plurality of the projections to open and close-repeatedly to provide an repetitive action of kneading and pushing/stretching the scalp. Accordingly, the scalp massage and the scalp and hair wash are achieved.

14 Claims, 11 Drawing Sheets

FOREIGN PATENT DOCUMENTS

| | | |
|---|---|---|
| JP | 2001-000245 | 1/2001 |
| JP | 2001-186929 | 7/2001 |
| JP | 2001-1258974 | 9/2001 |
| JP | 2004-057431 | 2/2004 |
| JP | 2005-270490 | 10/2005 |
| JP | 2006-034941 | 2/2006 |
| WO | WO 91/04002 A | 4/1991 |
| WO | WO 95/17836 | 7/1995 |
| WO | WO 2005/016454 A1 | 2/2005 |
| WO | WO 2005/025478 A1 | 3/2005 |

* cited by examiner

MASSAGING DEVICE

BACKGROUND OF INVENTION

1. Field of the Invention

The present invention relates to a massaging device.

2. Related Prior Art

Conventionally, as this kind of the massaging device, double-purpose brushes for massaging and washing electrically are known, for example, in Japanese un-examined patent publication No. 2001-258974. In the brushes, a vibratory head is attached via an elastic member to a casing containing a motor, and a motor shaft of the motor is protruded in the vibratory head, and an oscillator is eccentrically attached to the motor shaft. And further a brush section made of a flexible material is attached to a side surface of the vibratory head. The double-purpose brush comprises a brush body section serving as a body plate formed in a disk-shape and needle-like pieces serving as a number of projections protruded from a side surface of the brush body section. When this double-purpose brush is used, a user, first, holds the casing to place the brush section over his/her scalp and then activates a motor. As a result, vibration caused by the eccentric rotation of the oscillator built in the vibratory head, is transferred to the scalp via the vibratory head and the brush section. The brush section is made of such a flexible material that debris and sebum in the pores are removed without injuring the scalp while a massage is performed.

According to the conventional technique, when scalp massage at hair wash or massage against the affected area etc. are performed, the vibration caused by the eccentric rotation of the oscillator built in the vibratory head, is transferred to the scalp via the vibratory head and the brush section made of the flexible material. The brush section, however, simply vibrates against the scalp, so that massage cannot be sufficiently performed on the scalp etc. and the debris of the scalp can not be sufficiently removed, either.

SUMMARY OF THE INVENTION

To solve the above problems, it is, therefore, an object of the present invention to provide massaging device for performing massage and hair wash gently and effectively by a treating section thereof.

According to a first aspect of the present invention, there is provided a massaging device comprising: a treating section including: a body plate made of a flexible material; and a plurality of projections protruded in a direction intersecting with an surface of said body plate; and a drive section, wherein a frame is attached to the drive section retaining a periphery of the body plate of the treating section under a condition where an orientation relative to the drive section is substantially fixed, and a reciprocating drive means for deflecting the body plate in a direction intersecting with a surface of the body plate is disposed in the drive section.

According to a second aspect of the present invention, there is provided a massaging device comprising: a treating section including: a body plate made of a flexible material; and a plurality of projections protruded in a direction intersecting with a surface of said body plate; and a plurality of projections protruded in a direction intersecting with a surface of the body plate; and, a drive section, wherein a frame attached to the drive section retaining a periphery of the body plate of the treating section under a condition where an orientation relative to the drive section is substantially fixed, and a reciprocating drive means for deflecting the body plate in a direction intersecting with a surface of the body plate is disposed in the drive section; wherein assuming that an oscillatory direction of at the maximum amplitude section of the body plate is set as a central axis line X, a plurality of the projections include first projections, each having an opposed surface, the opposed surface facing the central axis line and having a triangular shape with a side of a distal end tapered and with a side of a proximal end, which is connected to the body plate, widened gradually.

BRIEF DESCRIPTION OF THE DRAWINGS

The invention will be more readily understood by reference to the following description, taken with the accompanying drawings, in which.

DETAILED DESCRIPTION OF THE INVENTION

Figure 1:
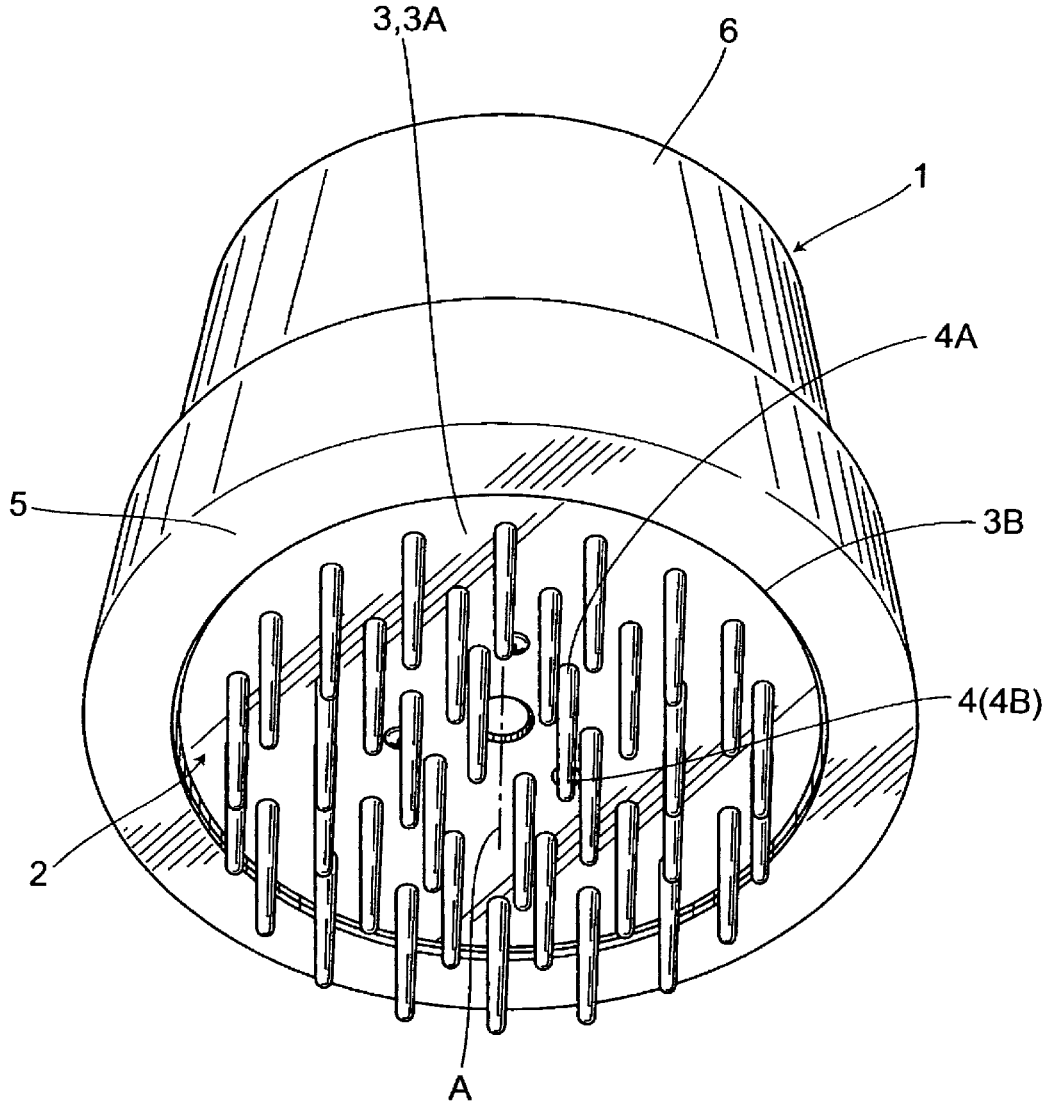
FIG. 1 is a perspective view showing a first embodiment according to the present invention.
Figure 2:
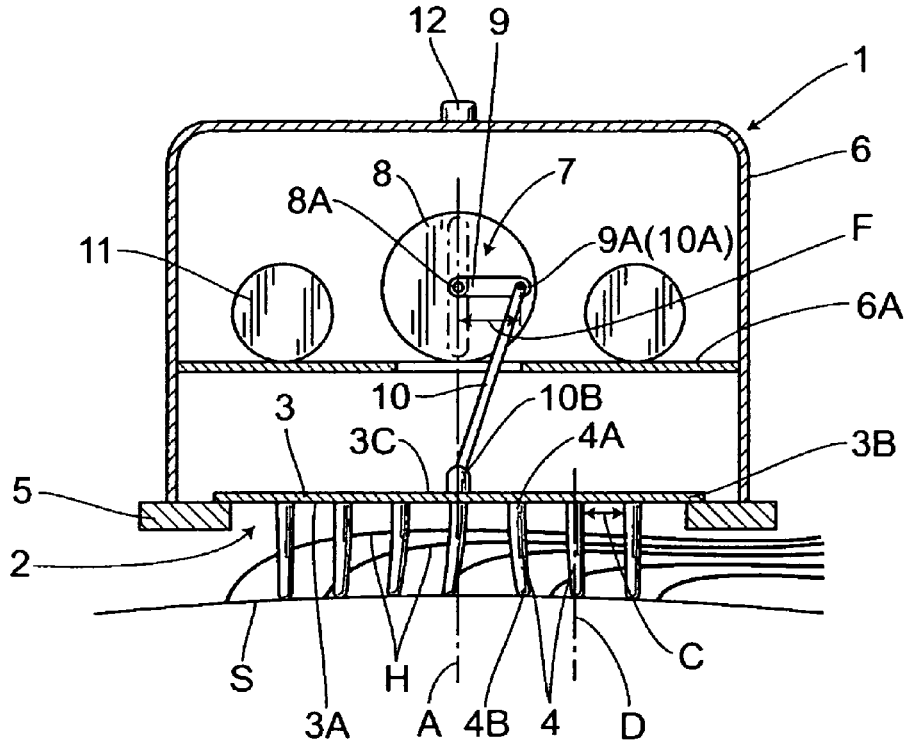
FIG. 2 is a full sectional diagram viewed from a front side of a motor showing the first embodiment according to the present invention.
Figure 3:
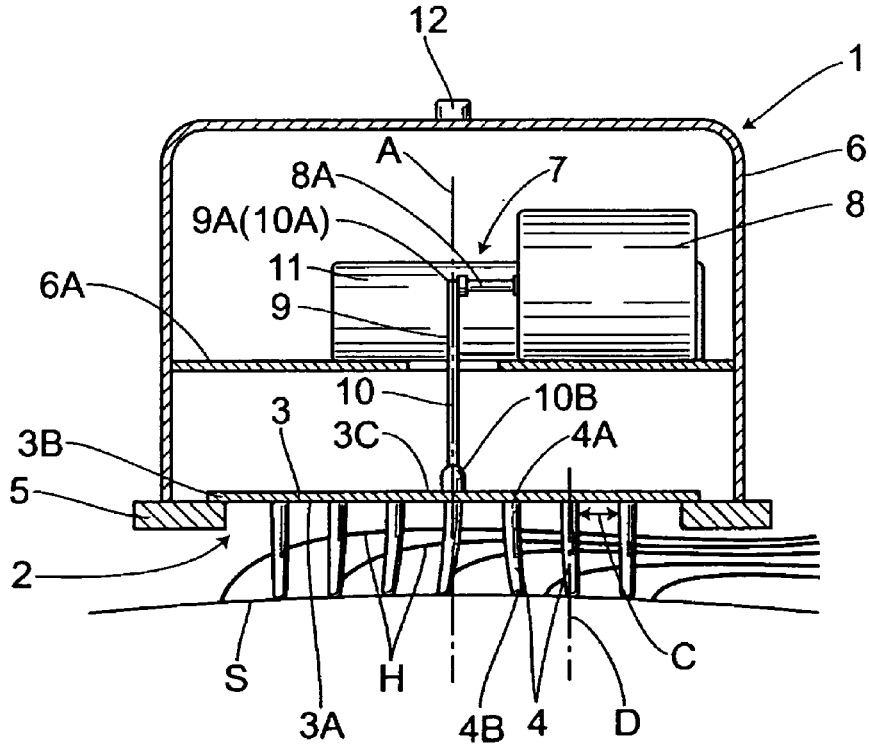
FIG. 3 is a full sectional diagram viewed from a lateral side of a motor showing the first embodiment according to the present invention.

Next is a detailed description of preferred embodiments according to the present invention with reference to the accompanying drawings.

Embodiment 1

FIGS. 1-5 show a first embodiment according to the present invention. A brushing device 1 serving as a massaging device, has a brush section 2 serving as a treating section provided on the lower side of the brushing device 1. The brush section 2 includes a body plate 3 and a plurality of projections 4 which are protruding from and integrally mounted on a surface 3A of the body plate 3. The body plate 3 has a disc-shaped structure with an axis line A at a center, and is made of flexible soft synthetic resin. An edge 3B of the body plate 3 is fixed around an interior periphery of a frame 5 of the brushing device 1. The plurality of projections 4 has a bar-like shape with a proximal end 4A which is slightly thicker than the opposite end, while are integrally formed with the body plate 3 to be substantially symmetrical with respect to the axis line A. Each of the projections 4 is protruded so that an axis line D thereof intersects with the surface 3A of the body plate 3. The proximal ends 4A of the projections 4 are maintained to be substantially perpendicular to the surface 3A of the body plate 3, regardless of deflection of the body plate 3.

The frame 5 is made of an inflexible hard synthetic resin and fixes the body plate 3 with the entire circumference of the edge 3B. The frame 5 has an annular shape with the axis line A at a center. In addition, the body plate 3 is broadly formed in a width direction B which intersects with the axis line A at right angles, and the plurality of projections 4 are spaced apart each other with an interval C.

Figure 4:
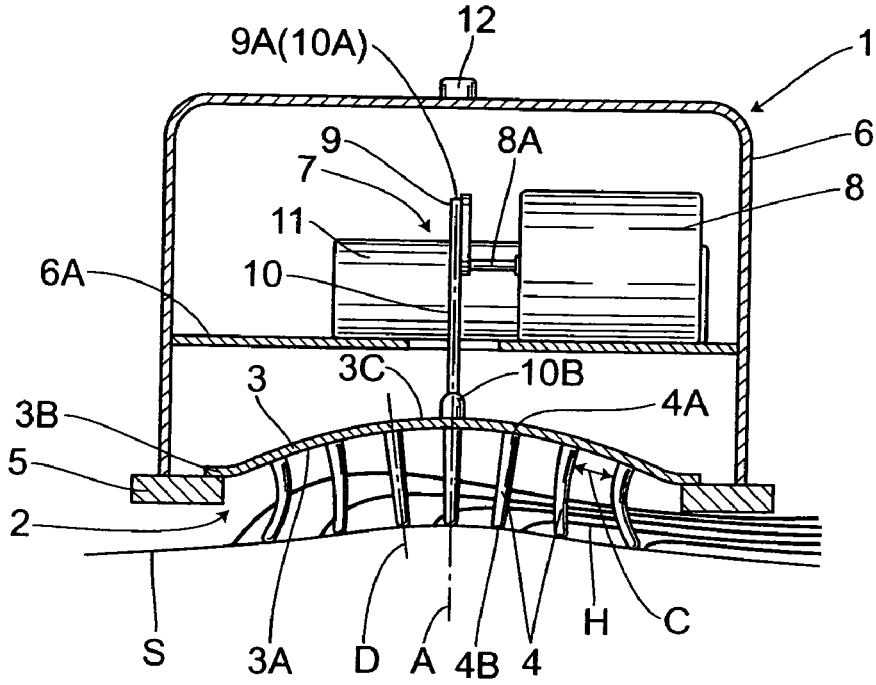
FIG. 4 is a full sectional diagram showing a concave position of a body plate in the first embodiment according to the present invention.
Figure 5:
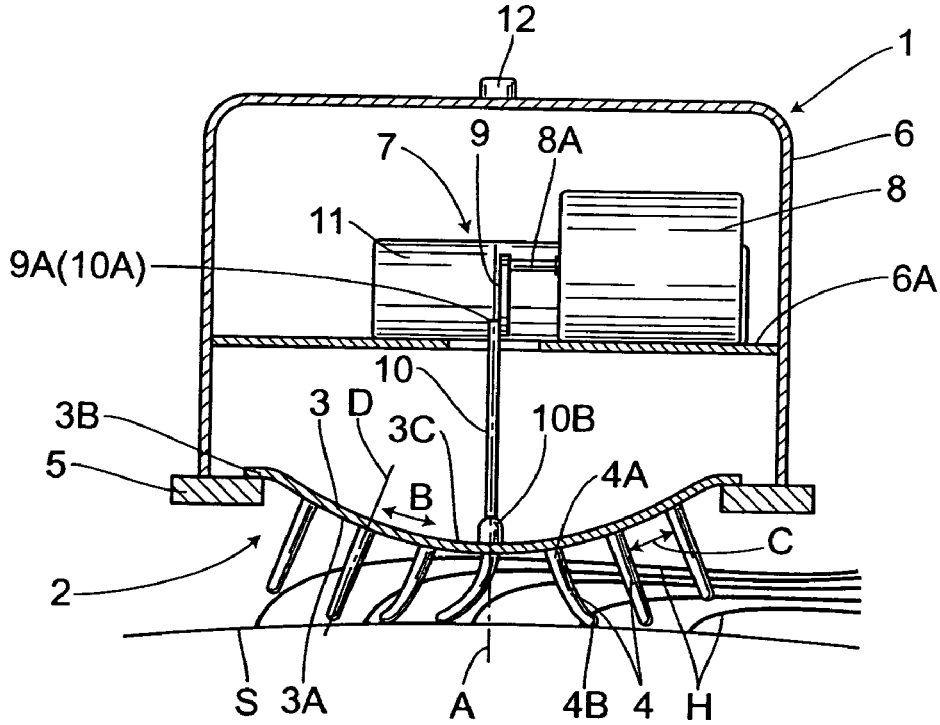
FIG. 5 is a full sectional diagram showing a convex position of a body plate in the first embodiment according to the present invention.

A cover 6 of a drive section is integrally provided with the frame 5 to cover an upper side of the body plate 3. A reciprocating drive means 7 provided within the cover 6, which reciprocates a central portion of the body plate 3 in up and down directions along the axis line A. The reciprocating drive means 7 comprises: a motor 8 serving as a drive section integrally disposed with the frame 5 through a mounting/receiving member 6A, such as a bracket in the cover 6; a crank mechanism 9 attached to a motor shaft 8A of the motor 8; and a connecting rod 10 having a side 10A and the other side 10B, said side 10A rotatably connecting to an eccentric shaft 9A of the crank mechanism 9, and the other side 10B swingably connecting to the other surface 3C of the body plate 3 roughly corresponding to a center thereof. The motor 8 has a speed reduction mechanism (not shown) which reduces its rotational speed at a desired speed reduction ratio to rotate the motor shaft 8A. An eccentric distance between the motor shaft 8A of the motor 8 and the eccentric shaft 9A of the crank mechanism 9 is F. Accordingly, when the motor shaft 8A of the motor 8 rotates, the rotation of the motor shaft 8A is converted into the reciprocating motion by the crank mechanism 9 and the connecting rod 10 and the central portion of body plate 3 reciprocates in up and down directions along the axis line A as well. As described above, the edge 3B of the body plate 3 is secured to the frame 5, so that the edge 3B does not move although the central portion of the body plate 3 reciprocates in up and down directions along the axis line A. Therefore, due to the rotation of the motor 8, the body plate 3 provides deformation between an upwardly-deflected curved concave position and a downwardly-deflected curved convex position, as shown in FIGS. 4 and 5. Further, a battery case 11 for accommodating a battery (not shown) is included in the cover 6, while a switch 12 activating the motor 8 is provided on a surface of the cover 6.

Now, the operation of the above described configuration according to the present invention will be described. When the user washes his/her hair, he/she grabs the brushing device 1 first and presses the distal ends 4B of the projections 4 of the brush section 2 against a scalp S. At that time, the distal ends 4B of the projections 4 are pressed against the scalp S. with light force. And then when the switch 12 is turned on, electric power is fed from the battery (not shown) and the motor 8 is activated to rotate the motor shaft 8A. In accordance with the rotation, the crank mechanism 9 attached to the motor shaft 8A rotate. That is, the rotational motion of the motor shaft 8A is converted into the reciprocating motion by the crank mechanism 9 and the connecting rod 10, while the central portion of the body plate 3 connected to the connecting rod 10 reciprocates along the axis line A. As a result, as described above, the body plate 3 repeats deflection having amplitude of 2F between the upwardly-deflected curved concave position and the downwardly-deflected curved convex position.

As shown in FIG. 4, when the eccentric shaft 9A of the crank mechanism 9 is located above the motor shaft 8A, the body plate 3 is pulled by the connecting rod 10 to become the upwardly-deflected curved concave position in which its center is brought to the uppermost part. In accordance with the deflection of the surface 3A of the body plate 3, at least the proximal ends 4A of the projections 4, which are formed to provide projection integrally with the body plate 3 in order to intersect with the surface 3A of the body plate 3 at right angles, integrally moves with the surface 3A maintaining the intersection at right angles with its surface, thereby causing each distance among the distal ends of the plurality of projections 4 to close, i.e. causing the axis lines D in at least proximal ends 4A of the plurality of projections 4 to move inwardly each other. In practice, as described above, the distal ends 4B of the projections 4 are pressed against the scalp S with the light force so that the distal ends 4B of the projections 4 consistently abut on the scalp S. As a result, at least the proximal ends 4A thickly formed in the projections 4 made of the flexible soft synthetic resin and mounted around the circumference side of the body plate 3, are slightly deflected but not substantially deformed, maintaining the perpendicular position with regard to the surface 3A of the body plate 3. Meanwhile, the distal end 4B's side thinly formed abuts on the scalp S in a widely-deflected state. Thus, the body plate 3 of the brush section 2 is upwardly-deflected by the rotation of the motor 8 in this way, and thereby causing the projections 4 to move inwardly abutting on the scalp S. At this time, the scalp S is massaged in a kneading manner by the distal ends 4B of the projections 4, and not only the scalp S but also hairs H are washed, for example, by shampoo. As described above, in accordance with the force for imposing the brush section 2 on the scalp S and the movement of the projections 4, the distal ends 4B are deflected to allow the scalp S to be massaged and washed with gentle and soft touches.

After this, as the eccentric shaft 9A of the crank mechanism 9 rotates downward from the top dead center, the body plate 3 is urged by the connecting rod 10 to be gradually deformed until it reaches the downwardly-deflected curved convex position, where the center thereof is the lowest part, as shown in FIG. 5. In the process, in accordance with the deflection of the surface 3A of the body plate 3, at least the proximal ends 4A of the projections 4 integrally moves with the surface 3A maintaining the intersection at right angles with its surface, thereby causing each distance among the distal ends 4B of the projections 4 to open, i.e. causing the axis lines D in at least proximal ends 4A of the plurality of projections 4 to move outwardly each other. In practice, as described above, the distal ends 4B of the projections 4 are pressed against the scalp S with the light force so that the distal ends 4B of the projections 4 consistently abut on the scalp S. As a result, at least the proximal ends 4A thickly formed in the projections 4 made of the flexible soft synthetic resin and mounted around the central portion of the body plate 3, are slightly deflected but not substantially deformed, maintaining the perpendicular condition with regard to the surface 3A of the body plate 3. Meanwhile, the distal end 4B's side thinly formed, abuts on the scalp S in a widely-deflected state. Thus, the body plate 3 of the brush section 2 is downwardly deflected by the rotation of the motor 8 in this way, and thereby causing the projections 4 to move outwardly abutting on the scalp S. At this time, the scalp S is massaged in a stretching manner by the distal ends 4B of the projections 4, and not only the scalp S but also hairs H are washed, for example, by shampoo. As described above, in accordance with the force for imposing the brush section 2 on the scalp S and the movement of the projections 4, the distal ends 4B are deflected to allow the scalp S to be massaged and washed with gentle and soft touches.

In this manner, by the crank mechanism 9 and the connecting rod 10, the rotational motion of the motor 8 is converted into the reciprocating motion to repeatedly deflect the body plate 3 of the brush section 2 in a state keeping the projections 4 connected to the scalp S and repeatedly open and close each distance among the plurality of projections 4 integrally mounted on the body plate 3. By doing so, massage is performed providing the scalp S with stimulation such as kneading and stretching by the plurality of projections 4, and not only the scalp S but also hairs H are washed by the acting of the shampoo and the rubbing of the distal ends 4B of the projections 4 against the scalp S due to the above movement of the plurality of projections 4.

As stated above, in the present embodiment, the plurality of projections 4 are integrally formed with the body plate 3 at the surface 3A of the brush section 2 having a flexibility in order for the projections 4 to be symmetrical with respect to the axis line A of the body plate 3 and for the axis line D to intersect with the surface 3A of the body plate 3 at right angles; the edge 3B of the body plate 3 is secured to the frame 5. Thus, by utilizing the reciprocating drive means 7 and activating the motor 8 serving as a drive section, the body plate 3 connected to the reciprocating drive means 7 is repeatedly deflected along the axis line A between the upwardly-deflected curved concave position and the downwardly-deflected curved convex position, thereby causing each distance among the plurality of projections 4 mounted on the body plate 3 to open and close repeatedly. Accordingly, the motion of kneading and stretching the scalp S is repeated and the massage of the scalp S and the washing of the scalp S and hairs H can be performed.

In addition, in the present embodiment, the proximal ends 4A of the projections 4 are formed to be thicker than the distal ends 4B, thereby keeping the axis lines D of the projections 4 perpendicular to the surface 3A of the body plate 3, regardless of the deflection of the body plate 3. Accordingly, when the brush section 2 is operated pressing the distal ends 4B of the projections 4 against the scalp S, each distance among the plurality of projections 4, however, are repeatedly opened and closed to ensure that the massage of the scalp S and the washing of the scalp S and hairs H are reliably performed.

Moreover, in the present embodiment, the distal ends 4B of the projections 4 are formed to be thinner than the proximal ends 4A, thereby causing deflection when the distal ends 4B of the projections 4 are pressed against the scalp S. Accordingly, the massage of the scalp S and the washing of the scalp S and hairs H are gently performed.

Moreover, in the present embodiment, the entire circumference 3B of the body plate 3 is secured to the frame 5, so that the inflection and deformation of the body plate 3 may be uniformly performed and the washing of the scalp S and hairs H may be performed well.

Embodiment 2

Figure 6:
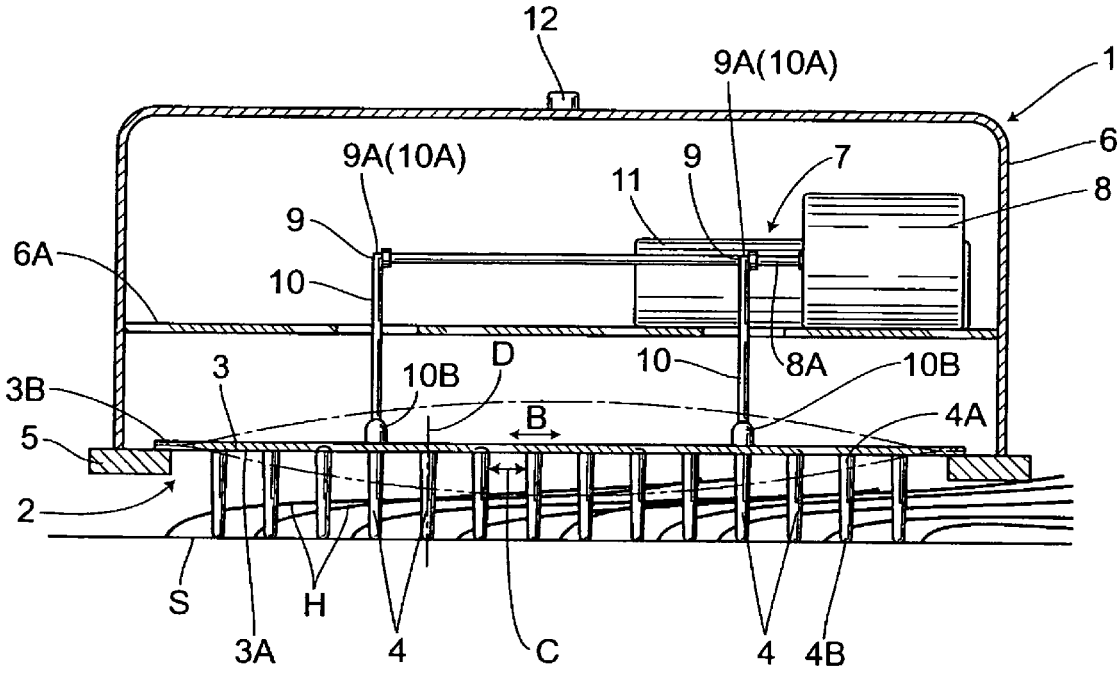
FIG. 6 is a full sectional diagram showing a second embodiment according to the present invention.

FIG. 6 shows a second embodiment according to the present invention, where the elements that are the same as those of the first embodiment shall be provided with the same symbols and the description for those details shall be omitted. In the second embodiment, the reciprocating drive means 7 is connected, at several locations, to the single body plate 3 which is made of flexible soft synthetic resin and on which the plurality of projections 4 are integrally mounted, in order to repeatedly reciprocate the body plate 3 allowing for its deflection. Thus, the reciprocating drive means 7 is connected to the single body plate 3 at several locations, so that the body plate may be adequately deflected, even though the body plate 3 has a wide area. Accordingly, the massage of the scalp S and the washing of the scalp S and hairs H are adequately performed.

Embodiment 3

Figure 7:
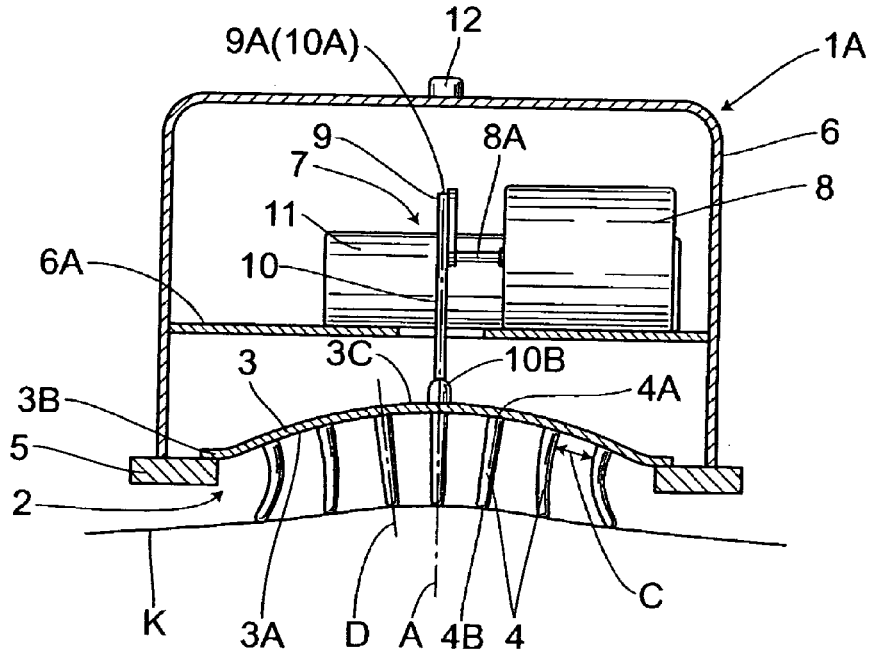
FIG. 7 is a full sectional diagram showing a concave position of a body plate in a third embodiment according to the present invention.
Figure 8:
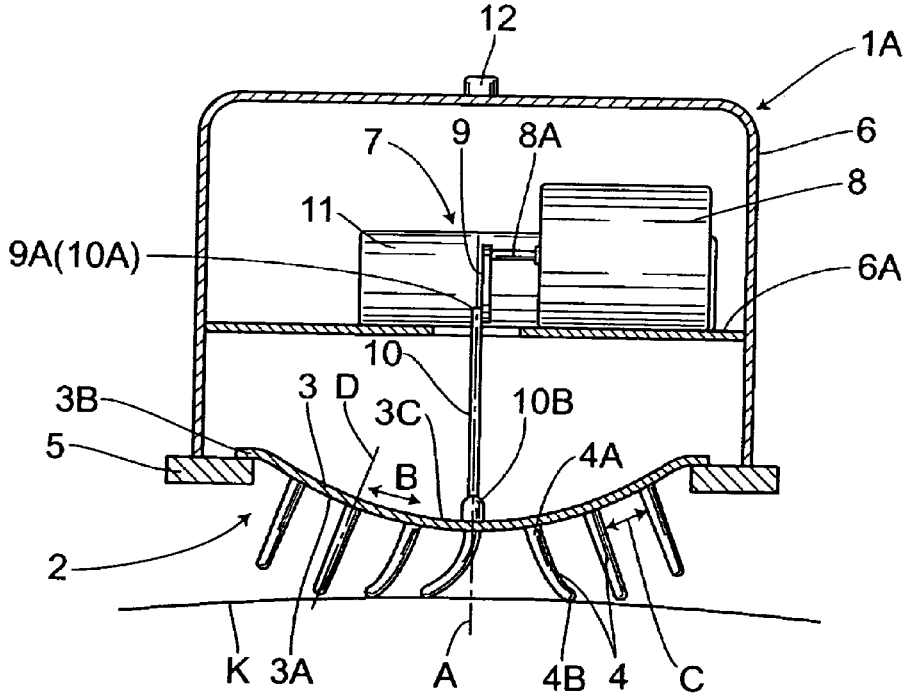
FIG. 8 is a full sectional diagram showing a convex position of a body plate in the third embodiment according to the present invention.

FIGS. 7 and 8 show a third embodiment according to the present invention, where the elements that are the same as those of the first embodiment shall be provided with the same symbols and the description for those details shall be omitted. The third embodiment shows an example for applying a massaging device 1A, which has the same configuration as that of the brushing devices of the respective embodiments described above and has the brush section 2 serving as a treating section.

When the user massages his/her affected area K, for example, an arm, a shoulder, and a waist, he/she grabs the massage device 1A first and presses the distal ends 4B of the projections 4 of the brush section 2 against the affected area K. At that time, the distal ends 4B of the projections 4 are pressed against the affected area K with light force. And then when the switch 12 is turned on, as described above, the rotational motion of the motor shaft 8A is converted into the reciprocating motion by the connecting rod 10, and the central portion of the body plate 3 connected to the connecting rod 10 reciprocates along the axis line A so that the body plate 3 repeats deflection having amplitude of 2F between the upwardly-deflected curved concave position and the downwardly-deflected curved convex position. As shown in FIG. 7, the eccentric shaft 9A of the crank mechanism 9 is located above the motor shaft 8A, and the body plate 3 is pulled by the connecting rod 10 to become the upwardly-deflected curved concave position, in which its center is brought to the uppermost part. Accordingly, the body plate 3 of the brush section 2 is upwardly deflected by the rotation of the motor 8 in this way, thereby causing the projections 4 to move inwardly abutting on the affected area K. At this time, the affected area K is massaged in a kneading manner by the distal ends 4B of the projections 4.

Subsequently, as the eccentric shaft 9A of the crank mechanism 9 rotates downward from the top dead center, the body plate 3 are urged by the connecting rod 10 to be gradually deformed until it reaches the downwardly-deflected curved convex position, where the center thereof is the lowest part, as shown in FIG. 8. Accordingly, the body plate 3 of the brush section 2 is downwardly deflected by the rotation of the motor 8 in this way, thereby causing the projections 4 to move outwardly abutting on the affected area K. At this time, the affected area K is massaged to be pushed and stretched by the distal ends 4B of the projections 4.

As described above, in accordance with the force for imposing the brush section 2 on the affected area K and the movement of the projections 4, the distal ends 4B are deflected to allow the affected area K to be massaged with gentle and soft touches.

In addition, in the third embodiment the massaging device has a frame 5 disposed to support the entire circumference of the body plate 3; at least proximal ends 4A of the projections 4 being formed to maintain constant angles with respect to the body plate 3, regardless of the deflection of the body plate 3; at least distal ends 4B of the projections 4 made of a flexible material. Accordingly, this allows the massaging device of the present embodiment to perform the similar functions and effects to the respective embodiments previously described.

Embodiment 4

Figure 9:
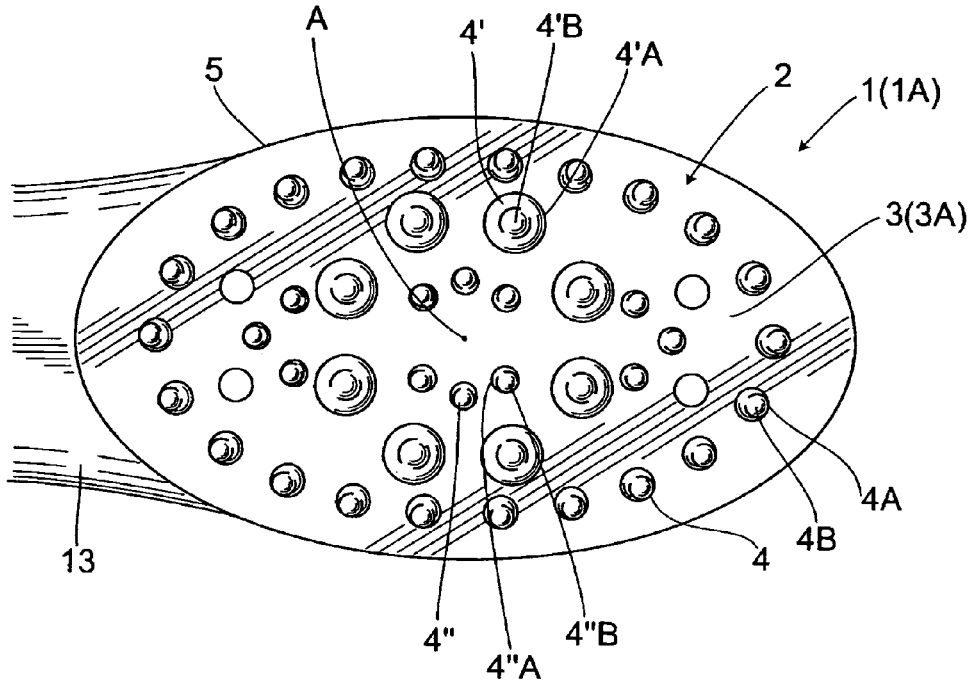
FIG. 9 is a front view of a brush or treating section in a fourth embodiment according to the present invention.
Figure 10:
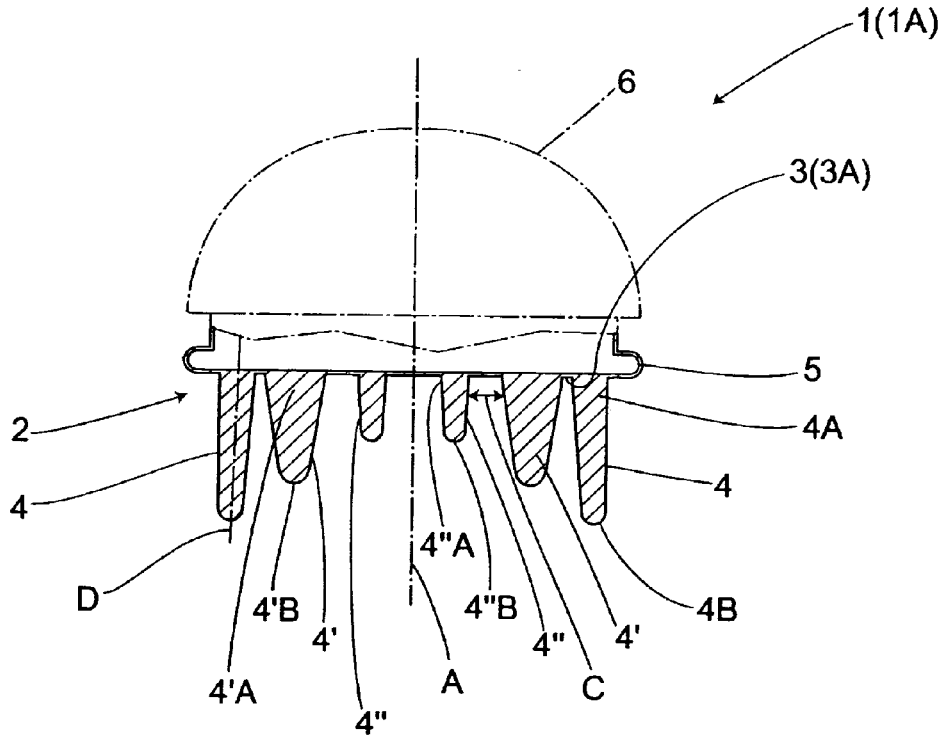
FIG. 10 is an illustrative sectional view of a brush or treating section in the fourth embodiment according to the present invention.
Figure 11:
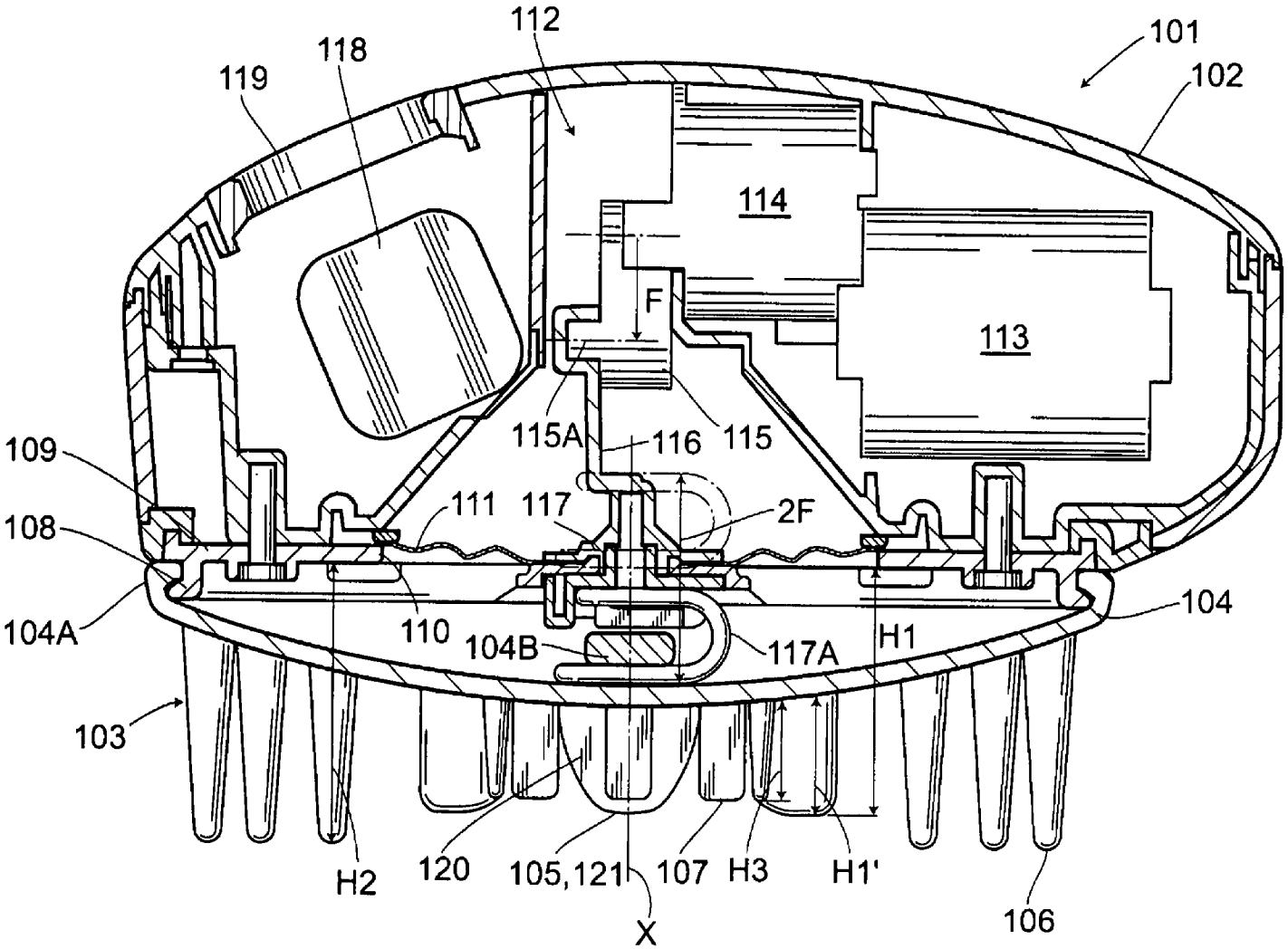
FIG. 11 is a cross-sectional view showing a fifth embodiment according to the present invention.
Figure 12:
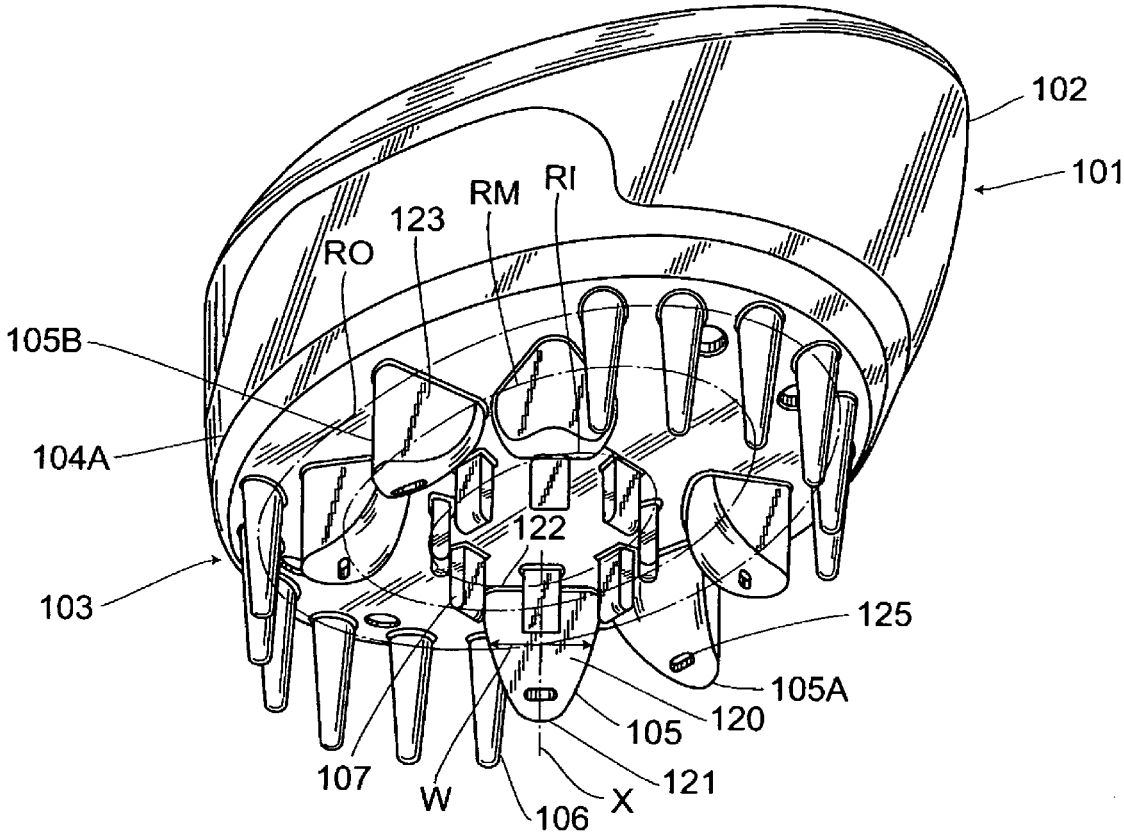
FIG. 12 is a perspective view showing the fifth embodiment according to the present invention.
Figure 13:
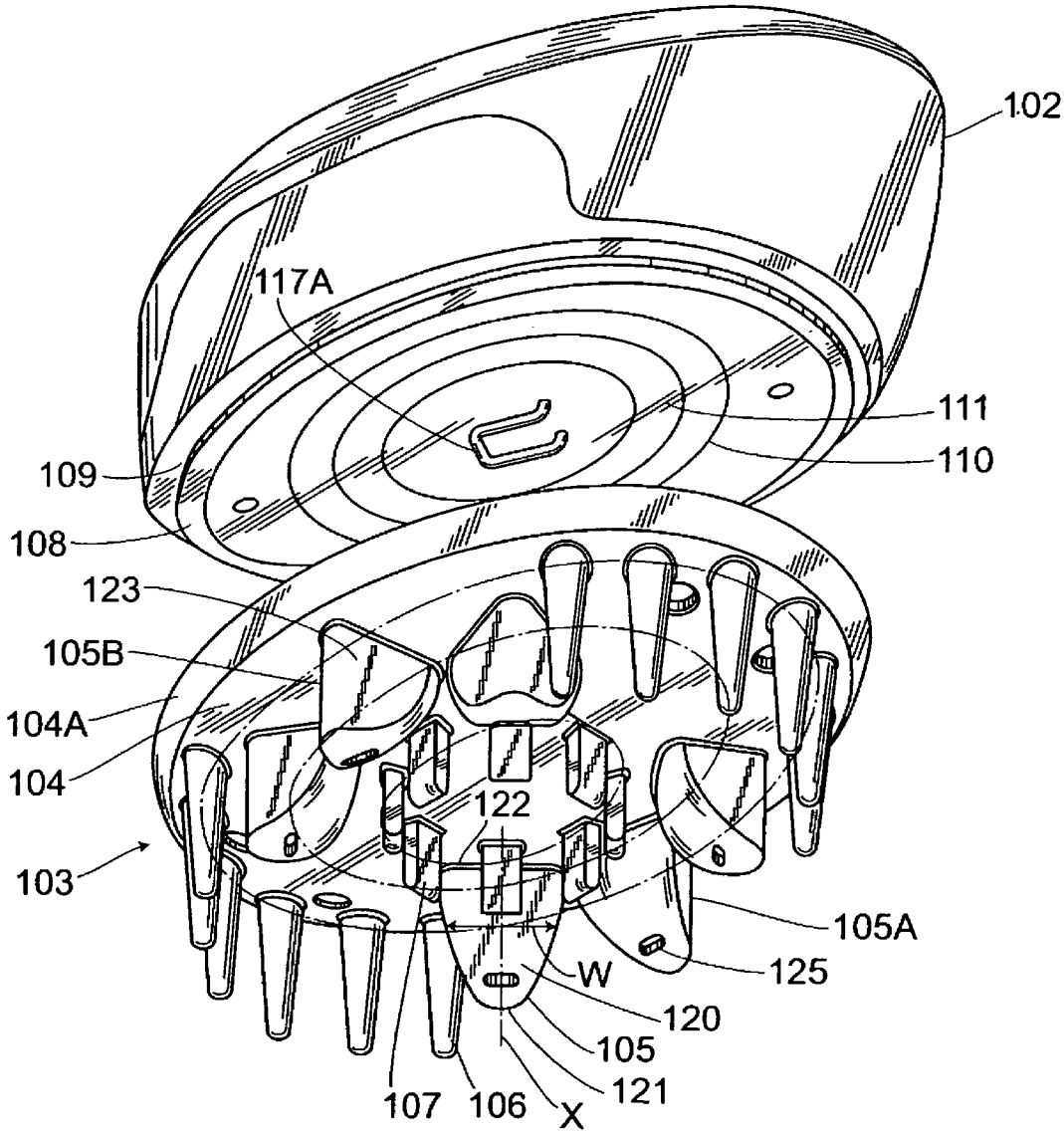
FIG. 13 is an exploded perspective view showing the fifth embodiment according to the present invention.

FIGS. 9 and 10 show a fourth embodiment according to the present invention, where the elements that are the same as those of the respective embodiment described above shall be provided with the same symbols and the description for those details shall be omitted. In the fourth embodiment, the brushing device 1 or the massaging device 1A includes the projections 4 and projections 4' and 4" which are different in length and/or in thickness than the projections 4, and the body plate 3 is substantially shaped to be a planar oval. As shown in FIG. 9, a handle section 13 is integrally incorporated in the brushing device 1.

The projections 4' are formed so as to be shorter than the projections 4 and the proximal ends 4'A of the projections 4' to be thicker than the proximal ends 4A of the projections 4. Accordingly, the projections 4' have lower flexibility (the ability to be deflected easily) than that of the projection 4, and, in use, keep themselves substantially perpendicular to the surface 3A of the body plate 3. The projections 4" are formed so as to be shorter than the projections 4 and 4' and the proximal ends 4"A of the projections 4" to be as thick as the proximal ends 4A of the projections 4. As a result, the projections 4" have lower flexibility than the projections 4, depending on the their shortness and, in use, when the same magnitude of force is applied on the projections 4, 4', 4", the deflection at the distal ends 4"B of the projections 4" are smaller than that of the projections 4. The configuration of projections 4' and 4" is the same as that of the projection 4 except for the difference in length and/or thickness of the projections 4' and 4". A plurality of the projections 4, 4' and 4" are integrally provided to the surface 3A of the body plate 3. The plurality of projections 4 are mounted on a circumferential region of the surface 3A of the body plate 3, and on a middle region of the surface 3A surrounded by the projections 4, a plurality (eight in this embodiment) of the projections 4' are arranged substantially annularly with respect to the central axis line A, and further on a central region surrounded by a plurality (six in this embodiment) of the projections 4" are arranged substantially annularly with respect to the central axis line A. By arranging in this manner, the heights of the projections 4, 4', and 4" are oriented to be shortened toward the central axis line A from the circumference of the surface 3A of the body plate 3. Due to the orientation, when massage and wash are performed on a curved convex region, for example the scalp S, the distal ends 4A, 4'A and 4"A of the projections 4, 4', and 4" easily fit on the region.

And as described above, when the switch 12 is turned on, the central portion of the body plate 3 reciprocates along the axis line A so that the body plate 3 repeats deflection having amplitude of 2F between the upwardly-deflected curved concave position and the downwardly-deflected curved convex position. In this case, when the body plate 3 moves from the flat condition to the upwardly-deflected curved concave position, the projections 4 disposed on the circumferential region of the body plate 3 inwardly moves on the scalp S along with deflection of the distal ends 4B of the projections 4, keeping the projections 4 abutting on the scalp S, and the projections 4' and 4" disposed on the middle and central regions also move inwardly keeping themselves abutting on the scalp S. At that time, the scalp S is massaged to be kneaded mainly by the distal ends 4B of the projections 4, as well as not only the scalp S but also hairs H are washed, for example, by a shampoo. Subsequently, when the body plate 3 returns back to the flat condition and moves toward the downwardly-deflected curved convex position, the distal ends 4B outwardly move on the scalp S along with deflection, keeping the projections 4 disposed on the circumferential region of the body plate 3 abutting on the scalp S. The thick projections 4' on the middle region move outwardly along the scalp S while being hardly deflected after abutting on the scalp S. Furthermore, the thin and short projections 4" on the central region abut on the scalp S and then keeping this abutting condition, the distal ends 4"B thereof outwardly moves while being slightly deflected. Accordingly, the scalp S is massaged to be pushed and stretched by the distal ends 4B, 4'B, and 4"B of the projections 4, 4' and 4", as well as not only the scalp S but also hairs H are washed, for example, by a shampoo.

As stated above, in accordance with the pushing force of the brush section 2 onto the scalp S and the movement of the projections 4, the distal ends 4B of the projections 4 of the circumference region are deflected so as to allow the scalp S to be massaged with gentle and soft touches, and the projections 4' and 4" on the middle and central regions are moved along the scalp S while being slightly deflected. Thus, in the fourth embodiment, the projections 4, 4', and 4", which have different length and/or thickness, provide various massage effects at the locations getting contact with the projections 4, 4', and 4". In addition, the heights of the projections 4, 4', and 4" are set to be lowered from the circumference of the surface 3A of the body plate 3 toward the center thereof, thereby, for example, making the whole of projections 4, 4', and 4" easier to fit along the curved convex regions of the top of head, and thus providing superior massage effects against the curved convex regions.

Embodiment 5

FIGS. 11-15 show a fifth embodiment according to the present invention. A massaging device 101 comprises a massager main body 102 serving as a drive section and a treating section 103 detachably attached to the underside of the main body 102. The treating section 103 has a body plate 104 and three different kinds of projections 105, 106, and 107 which are integrally provided on an undersurface of the body plate 104 in a manner to be protruded downwardly in a direction intersecting with the undersurface. The body plate 104 has an oval shape in plan view, and is made of flexible soft synthetic resin. An edge 104A of the body plate 104 is substantially fixed at a lower edge of the massager main body 102. The "substantially fixing" means to bond or to secure something allowing little movement, and in the present embodiment, to fit the edge 104A of the body plate 104 into a fixing frame 108 comprising a groove formed along the undersurface of the massager main body 102, in order to detachably connect with each other along the entire circumference.

Underneath the massager main body 102, a bottom plate 109 having an oval shape in plan view is fixed, and in the central region of the bottom plate 109, a circular window opening 110, which penetrates the bottom plate vertically, is formed. An extensible cover 111 covering the window opening 110 is disposed. The extensible cover 111 is a flexible accordion plate made of, for example, rubber, synthetic rubber or soft synthetic resin etc., and is provided to seal the window opening 110. Within the massager main body 102, a reciprocating drive means 112, which vertically reciprocates the central portion of the body plate 104, is disposed. The reciprocating drive means 112 has a motor 113 serving as a drive source disposed on the bottom plate 109, a crank mechanism 115 connected to a motor shaft 113A of the motor 113 via a speed reduction gear mechanism 114, and a connecting rod 116, such as a link, having a side which is rotatably coupled to an eccentric shaft 115A of the crank mechanism 115, and having the other side swingably coupled to about a center on a top surface of the body plate 104. Also, a connecting member 117 is integrally disposed roughly in the center of the cover 111. The connecting member 117 has an upper surface side which is connected to the other side of the connecting rod 116, and a down surface side where a hook 117A is disposed. A hook receiving section 104B disposed on the center surface of the body plate 104 is detachably connected to the hook 117A. Accordingly, the connecting member 117 vertically reciprocates in accordance with the rotation of the motor 113 via the crank mechanism 115. Therefore, the location, where the hook receiving section 104B is disposed, becomes a point of the maximum oscillation of the body plate 104 with amplitude of 2F, where the amplitude is twice (2F) as long as the eccentric distance F from the central axis of the crank mechanism to the eccentric shaft 115A, and a central axis line X is formed vertically through the hook receiving section 104B and the connecting member 117. A battery 118 for the motor 113 is disposed within the massager main body 102, and further, a switch 119 for the motor 113 is disposed on the upper side surface of the massager main body 102.

Now, the treating section 103 is described hereinafter. With respect to a central axis line X vertically passing through around the center of body plate 104, the projections 105, 106, 107 are respectively disposed: along a phantom outer ring RO, which has an oval shape and is positioned along an edge 104A of the body plate 104; along a phantom inner ring RI, which has nearly a circle shape and is positioned inside the ring RO; and along a phantom intermediate ring RM which has nearly a circle shape and is positioned between the rings RO and RI.

A plurality of the first projections 105 spaced apart from each other along the phantom intermediate ring RM, are also disposed and spaced apart to oppose to each other with respect to the central axis line X. In the present embodiment, the projections are configured so that, axisymmetrical placement of two sets of the three projections with an arcuate arrangement, leads to the first projections 105 having a total number of six. First projections 105A which constitute the set of the three projections on one side, are opposed, with respect to the central axis line X, to first projections 105B which constitute the set of the three projections on the other side. An opposed surface 120 of the first projection 105 facing to the central axis line X is formed with a distal end 121 tapered and with a width W gradually increased toward the proximal end 122, to integrally connect with the body plate 104, thereby forming roughly a triangular shape from the distal end 121 to the proximal end 122. The opposed surface 120 recedes in a curve convex shape to make a distance L from the central axis line X to the distal end 121 longer than that to the proximal end 122. The maximum width of the opposed surface 120 of the first projection 105 is formed to be about as large as a width of a finger, and the maximum height of the opposed surface 120 approximately corresponds to a length from a top joint to a tip of the finger.

In addition, the first projections 105 are protruded in a triangular pyramid shape integral with surfaces 123 on a right and left sides of the opposed surface 120, respectively. The first projections 105 are convexly integrated with the body plate 104, with about the same thickness as the thickness of the body plate 104, so that a hollow section 124 is formed within the first projection 105, at an upper side of which opening 124A is provided. Through the upper side opening 124A, the hollow section 124 is in communication with an upper part of the body plate 104, i.e. a space defined between the body plate 104 and the bottom plate 109. Meanwhile, a horizontally long communication section 125 is formed through an area close to a distal end 121 of the opposed surface 120 of the first projection 105, resulting in a communication between the hollow section 124 and an exterior of the first projection 105.

The second projections 106 spaced apart from each other along the phantom outside ring RO have a columnar shape and a rounded distal end. Said second projections 106 are formed to always keep height distance H2 from the bottom plate 109 constantly longer than a height distance H1 from the bottom plate 109 at the first projection 105. More specifically, although the first projection 105 moves vertically due to the deflection of the treating section 103 between the position of FIG. 14 and the position of FIG. 15, the second projection 106 is formed having a distal end to be constantly situated below the lowest position of the first projection 105. A plane area per one of the second projections 106 is formed to be smaller than a plane area of the first projection 105. Groups consisting of a plurality of the second projections 106 are disposed on the respective side of the long axis of the body plate 104 having an oval shape in plan view.

The third projections 107 spaced apart from each other along the phantom inside ring RI have a rectangular column shape and a rounded distal end, and are formed to always keep a height H3 from the body plate 104 smaller than a height H1' from the body plate 104 at the first projection 105. A plane area per one of the third projections 107 is formed to be smaller than a plane area of the first projection 105.

Now, the operation of the above configuration will be described. When massage or rubbing wash is performed on a scalp, for example, during washing hairs, a user, first of all, grabs the massager main body 102 and holds this in his/her hand pressing the distal ends of the first and second projections 105 and 106 against the scalp S. Next, when the switch 119 is turned on, electrical power is fed from the battery 118 to activate the motor 113 to rotate the motor shaft 113A. In the accordance with the rotation, the crank mechanism 115 connected to the motor shaft 113A via the speed reduction gear mechanism 114 is rotated, and then the rotating motion of the motor shaft 113A is converted into the reciprocating motion by the crank mechanism 115 and the connecting rod 116 coupled to an eccentric shaft 115A of the crank mechanism 115, and thereby to vertically reciprocate the connecting member 117 connected to the connecting rod 116. Then, the body plate 104 is repeatedly deformed between the downwardly-deflected curved convex position shown in FIG. 14 and the upwardly-deflected curved concave position shown in FIG. 15 to position the maximum amplitude location at the hook receiving section 104B connected to the connecting member 117, i.e. at the center of the body plate 104, where the amplitude is twice (2F) as long as the eccentric distance F from the central axis of the crank mechanism to the eccentric shaft 115A. Accordingly, the first projections 105 mainly repeat inclining inwardly with respect to the central axis line X and then rising, to perform a massage in a manner that the scalp S is rubbed. Due to the deflection of the body plate 104, the third projections 107 repeatedly abut on and move away from the scalp S to perform a massage in a manner that the scalp S is lightly tapped.

Furthermore, the second projections 106 are formed in the vicinity of the outer circumference and in both sides of the long axis of the body plate 104 having an oval shape. Thus, even if the body plate 104 is deflected, the projections 106 swings somewhat but hardly move. Although the hardly moving second projections 106 may not substantially perform the massage by themselves, the second projections 106 may keep a distance between the massager main body 102 and the scalp S to prevent the treating section 103 from being unduly pressed against the scalp S. If the treating section 103 is unduly pressed against the scalp S, reaction accompanied with standing and falling of the first projection 105 due to the deflection of the body plate 104, wildly vibrates the massager main body 102, or eventually the user's hand holding it in the direction of the central axis line X, or otherwise the reaction wildly swings the head, against which the treating section 103 is pressed, so that massaging by the first projections 105 may be poorly performed. The second projections 106, however, keep the distance between the massager main body 102 and the scalp S to prevent the treating section 103 from being unduly pressed against scalp S, and/or prevent the user's hand holding the massager main body 102 and the head against which the treating section 103 is pressed, from being wildly swung, so that massage is adequately performed.

Figure 14:
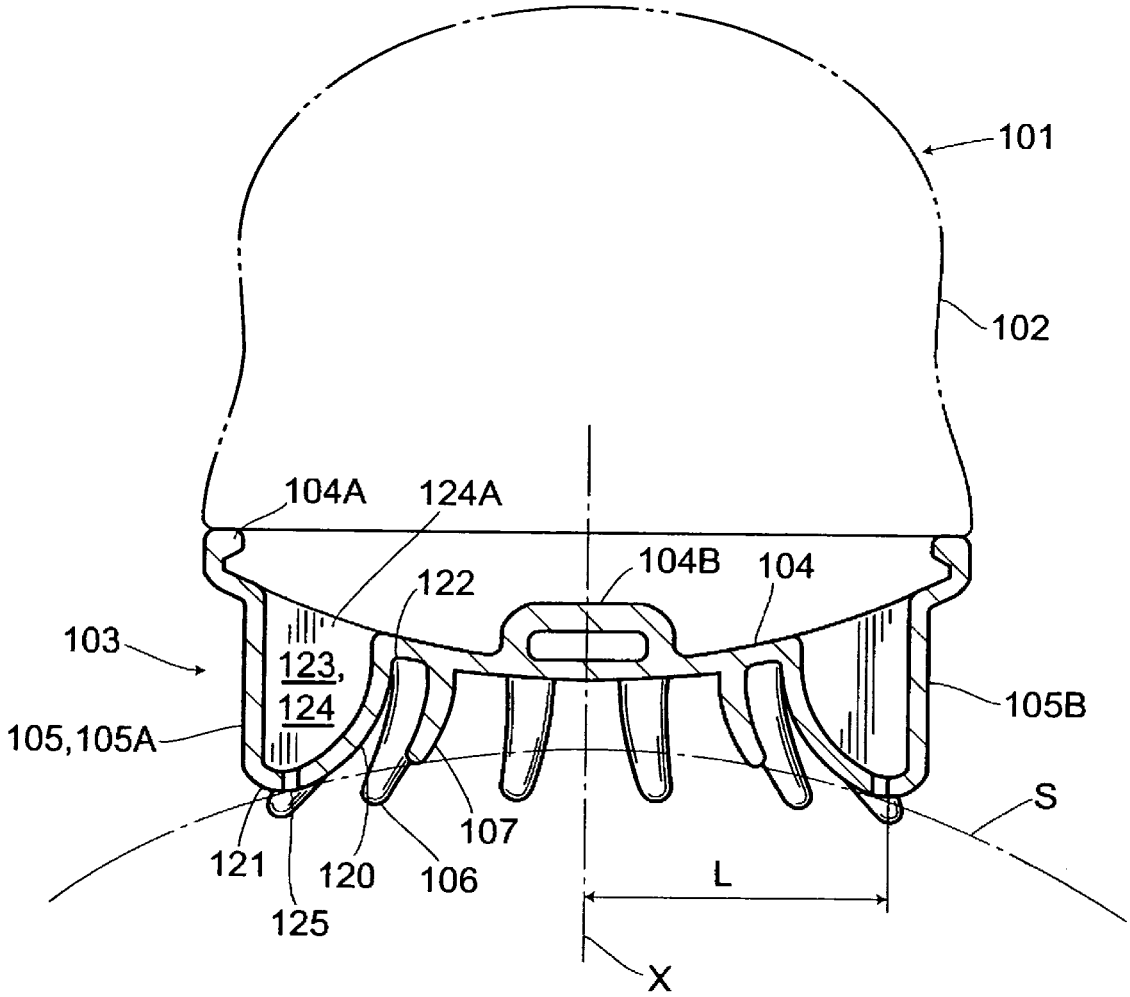
FIG. 14 is a cross-sectional view showing a curved convex position of a body plate and its vicinity in the fifth embodiment according to the present invention.
Figure 15:
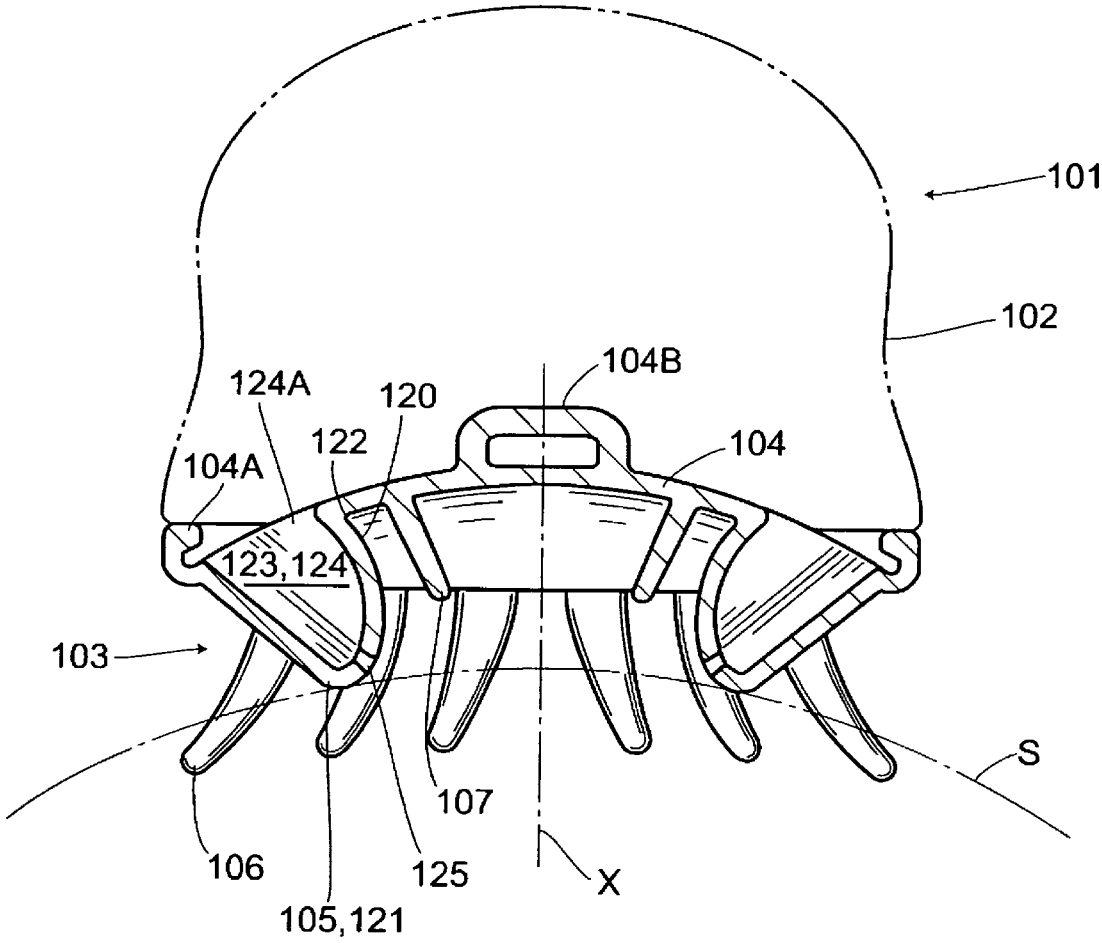
FIG. 15 is a cross-sectional view showing a curved concave position of a body plate and its vicinity in the fifth embodiment according to the present invention.

In addition, the deformation of the body plate 104 from the position of FIG. 14 to the position of FIG. 15, i.e. the deflection of the body plate 104 from the curved convex position to the curved concave position makes the first projections 105 fall inwardly abutting on the scalp, and thus massage is performed in a manner that the scalp S is grabbed by the first projections 105, as well as not only the scalp S but also the hairs (not shown) are washed with a shampoo etc. At this time, the opposed surface 120 facing the central axis line X of the first projections 105 is formed to have a triangular shape with its distal end 121 tapered and with proximal end 122 gradually widened, so that, in the position of FIG. 14, portions relatively closer to the proximal end 122 than the distal end 121 of the opposed surface 120 is gently touched on the scalp S and then as the deformation are progressing toward the position of FIG. 15, the portions closer to the distal end 121 having the tapered width is gradually touched on the scalp, resulting in the achievement of a finger-pressure treatment massage as if performed with fingertips. Moreover, the first projections 105 recede in a curved convex shape to make a distance from the central axis line X to the distal end 121 portion longer than that to the proximal end 122 portion. When contacted to the scalp S, the first projections 105 can incline inwardly or stand, so that the scalp S is massaged in a manner abutment of the opposed surface 120 over the scalp S can slide from the proximal end 122 portion to the distal end 121 portion. A plurality of the first projections 105 are spaced apart to oppose to each other with respect to the central axis line X, so that the massage can be performed in a manner that the scalp S is also rubbed by the first projections 105A and 105B facing each other, mutually. On the contrast, in a case the body plate 104 deforms from the position of FIG. 15 to the position of FIG. 14, that is, the body plate 104 deflects from the curved concave position to the curved convex position, the first projections 105 can provide gentle massage as if done with fingertips.

In addition, when the body plate 104 is repeatedly deformed between the downwardly-deflected curved convex position shown in FIG. 14 and the upwardly-deflected curved concave position shown in FIG. 15, the space between the body plate 104 and the bottom plate 109 is repeatedly compressed and restored, so that when compressed, air within the space between the body plate 104 and the bottom plate 109 is ejected from the communication section 125 onto the scalp S, to perform massage utilizing the air pressure.

As stated above, in the above-described embodiment, there is provided a massaging device 101 comprising a massager main body 102 serving as a drive section and a treating section 103 operated by the massager main body 102. The treating section 103 comprising a body plate 104 made of a flexible material, and a plurality of first projections 105 disposed to be protruded downwardly in a direction intersecting with a surface of the body plate 104. A frame 108 is integrally disposed with the massager main body 102 in order to hold circumference 104A of the body plate 104 of the treating section 103 in a condition that its location relative to the massager main body 102 is substantially fixed. A crank mechanism 115 for deflecting the body plate 104 in a vertical direction intersecting with a surface of the body plate 104 is disposed within the massager main body 102. Assuming that a direction of an amplitude at the central region providing the maximum amplitude of the body plate 104 is set as a central axis line X, an opposed surface 120 of the first projection 105 facing the central axis line X is formed so as to have a triangular shape with a side of a distal end 121 tapered and with a side of a proximal end 122 widened gradually, thereby when massage is performed, a region of the opposed surface 120 of the first projection 105, which abuts on a scalp S etc. shifts between the side of the tapered distal end 121 and the side of the widened proximal end 122, to achieve a massage similar to the actual fingertip massage.

In addition, the opposed surface 120 recedes in a curved convex shape to make a distance from the central axis line X to the distal end 121 portion longer than that to the proximal end 122 portion, so that a contact point of the opposed surface to the scalp S may move to slide between the distal end 121 portion and the proximal end 122 over the opposed surface 120, which is formed smoothly.

Furthermore, a plurality of the first projections 105A and 105B are spaced apart to oppose to each other with respect to the central axis line X, so that the massage can be performed in a manner that the scalp S is also pinched by the first projections 105A and 105B facing each other.

Additionally, the first projections 105 comprise a hollow section 124 therein, and a communication section 125 connecting the hollow section 124 to an exterior, which is disposed in the opposed surface 120, so that when the space above the body plate 104 is compressed in accordance with the deformation of the curved convex/concave positions of the body plate 104, the air within the space is blown down onto the scalp S through the communication section 125 to provide pneumatic massage action.

The first projections 105 is substantially shaped to a triangular pyramid with surfaces 123 integrally provided at the both sides of the opposed surface 120, respectively, so that the surfaces 123 reinforce the opposed surface 120. Accordingly, the desired strength of the first projections 105 can be secured and thus the first projections 105 are not likely to collapse readily, when abutted on the scalp S.

In addition, a plurality of second projections 106 which are formed to be higher than the first projections 105, are disposed along the circumferential section on both sides of the long axis of the body plate 104, so that the second projections 106 hardly moves due to the deflection of the body plate 104, keeping a gap between the massager main body 102 and the scalp S, thereby providing the adequate massage by the first projections 105.

Moreover, the present invention is not limited to the above exemplary embodiments, and various modifications can be made within the scope of the present invention. For example, the plurality of projections may be provided so as to intersect slightly inclining toward the direction of the body plate surface, although the plurality of the projections, in the above respective embodiment, are formed to be substantially perpendicular to the direction of the body plate surface. Furthermore, although the plurality of connecting rods in the reciprocating drive means, in the second embodiment, are configured to have the same phase, different phases may be used as necessary. In the above respective embodiment, the reciprocating drive means comprises a motor, a crank mechanism, and a connecting rod, the means, however, may comprise a solenoid and a plunger, or a linear motor etc. Further, although the body plate of the brush section is shaped to be planar in the above respective embodiment, it may be preferable to be shaped preliminarily with a downwardly convex curve, as shown in the fifth embodiment. If the planar-shaped body plate is used and pushed downwardly by the connecting rod, which is connected to the body plate in a freely swingable manner, the body plate may be obliquely pushed during the downward movement of the connecting rod. On the contrary, if the body plate of the brush section is preliminarily shaped to have a downwardly convex curve, more preferably, said convex curve deflected to the lowest end corresponding to the bottom dead center of the reciprocating drive means, when the reciprocating drive means moves from the bottom dead center to the top dead center, the body plate is pulled by the connecting rod; and when the reciprocating drive means moves from the top dead center to the bottom dead center, the body plate is pushed by the connecting rod as well as the body plate itself moves back to the downwardly convex position by the resilience of the body plate, the body plate and thus the brush section being nearly uniformly brought back to the downward convex position, to perform superior massage or the like on the scalp. It is noted that the affected area includes the scalp.

Moreover, in the above-described fifth embodiment, although the first projections are arranged substantially on the circular ring, the first projections may be arranged on an oval ring. Furthermore, in the above-described embodiment, although the crank mechanism is used as a reciprocating drive means, other means, for example, a linear motor, or an electromagnetic reciprocating drive mechanism comprising a solenoid and a permanent magnet, etc. may be used. In addition, in the above-described fifth embodiment, although airflow into and out of the communication section accomplishes the massage action, rather, a medical agent etc. may be stored in the massager main body to feed the medical agent directly onto the scalp through the communication section disposed in the vicinity of the distal end of the first projection, at the same time as the massage is performed.

What is claimed:

1. A massaging device comprising:

a treating section including: a body plate made of a flexible material, said body plate being shaped to be planar and circular, or to be a substantially planar oval; and a plurality of projections protruded in a direction intersecting with a surface of said body plate, the plurality of said projections being arranged substantially annularly with respect to a central axis line of said body plate; and, a drive section, wherein a frame is attached to said drive section retaining a periphery of said body plate of said treating section under a condition where an orientation relative to said drive section is substantially fixed, and a reciprocating drive means for deflecting said body plate in a direction intersecting with a surface of said body plate is disposed in said drive section, wherein by utilizing said reciprocating drive means, said body plate is repeatedly deformed between an upwardly-deflected curved concave position and a downwardly-deflected curved convex position.

2. The massaging device according to claim 1, wherein at least a distal end section of said projection is made of a flexible material, and at least proximal end section is formed so that an angle relative to said body plate is kept virtually constant, regardless of deflection of said body plate.

3. The massaging device according to claim 2, wherein said frame is disposed to hold entirety of said periphery of said body plate.

4. A massaging device comprising:

a treating section including: a body plate made of a flexible material, said body plate being shaped to be planar and circular, or a substantially planar oval; and a plurality of projections protruded in a direction intersecting with a surface of said body plate; and, a drive section, wherein a frame attached to said drive section retaining a periphery of said body plate of said treating section under a condition where an orientation relative to said drive section is substantially fixed, and a reciprocating drive means for deflecting said body plate in a direction intersecting with a surface of said body plate is disposed in said drive section, wherein by utilizing said reciprocating drive means, said body plate is repeatedly deformed between an upwardly-deflected curved concave position and a downwardly-deflected curved convex position;

wherein assuming that an oscillatory direction of said body plate at a maximum amplitude section thereof is set as a central axis line, a plurality of said projections are arranged substantially annularly with respect to said central axis line, and some of the plurality of said projections include first projections, each having an opposed surface, said opposed surfaces facing said central axis line and having a triangular shape with a side of a distal end tapered and with a side of a proximal end, which is connected to said body plate, widened gradually.

5. The massaging device according to claim 4, wherein a plurality of said first projections are spaced apart to oppose to each other with respect to said central axis line.

6. The massaging device according to claim 5, wherein said opposed surface recedes in a curved convex shape to make a distance from said central axis line to said distal end longer than that from said central axis line to said proximal end.

7. The massaging device according to claim 6, wherein said projections are substantially shaped to a triangular pyramid with surfaces integrally provided at both sides of said opposed surfaces.

8. The massaging device according to claim 5, wherein second projections are disposed on a circumferential section of said body plate, said second projection being formed to be higher than said first projection.

9. The massaging device according to claim 6, wherein second projections are disposed on a circumferential section of said body plate, said second projection being formed to be higher than said first projection.

10. The massaging device according to claim 7, wherein second projections are disposed on a circumferential section of said body plate, said second projection being formed to be higher than said first projection.

11. The massaging device according to claim 4, wherein a hollow section is formed within said first projection, and a communication section connecting said hollow section to an exterior is disposed in said opposed surface.

12. The massaging device according to claim 5, wherein a hollow section is formed within said first projection, and a communication section connecting said hollow section to an exterior is disposed in said opposed surface.

13. The massaging device according to claim 6, wherein a hollow section is formed within said first projection, and a communication section connecting said hollow section to an exterior is disposed in said opposed surface.

14. The massaging device according to claim 7, wherein a hollow section is formed within said first projection, and a communication section connecting said hollow section to an exterior is disposed in said opposed surface.

* * * * *